US006203360B1

(12) United States Patent
Harting et al.

(10) Patent No.: US 6,203,360 B1
(45) Date of Patent: Mar. 20, 2001

(54) CONDUCTOR-CONNECTING ELEMENT FOR CONNECTING ELECTRICAL CONDUCTORS TO INSULATION-DISPLACEMENT CONTACTS

(75) Inventors: Dietmar Harting, Espelkamp; Horst Nowacki, Lübbecke; Stephan Schreier, Rahden; Heinz Lambrecht, Lübbecke, all of (DE)

(73) Assignee: Harting KGaA (DE)

( * ) Notice: Subject to any disclaimer, the term of this patent is extended or adjusted under 35 U.S.C. 154(b) by 0 days.

(21) Appl. No.: 09/503,774

(22) Filed: Feb. 14, 2000

(30) Foreign Application Priority Data

Feb. 18, 1999 (GB) ..... 199 06 725

(51) Int. Cl.[7] ..... H01R 4/24; H01R 4/26; H01R 11/20

(52) U.S. Cl. ..... 439/412; 439/395

(58) Field of Search ..... 439/395, 411, 439/412, 417

(56) References Cited

U.S. PATENT DOCUMENTS 4,773,875 * 9/1988 Huiskes ..... 439/395
4,969,839 11/1990 Nilsson .
5,752,849 * 5/1998 Orlando ..... 439/412

FOREIGN PATENT DOCUMENTS 657 942 9/1986 (CH) .
295 12 585 1/1996 (DE) .
196 05 083 9/1996 (DE) .
197 25 732 1/1999 (DE) .
WO 97/60580 2/1997 (WO) .

* cited by examiner

*Primary Examiner*—Neil Abrams
*Assistant Examiner*—Javaid Nasri
(74) *Attorney, Agent, or Firm*—Cook, Alex, McFarron, Manzo, Cummings & Mehler, Ltd.

(57) ABSTRACT

For a conductor-connecting element for connecting electrical conductors, in which element contact with electrical conductors is made with the aid of insulation-displacement contacts in the guide ducts of a conductor-guiding part, it is proposed that the conductor-guiding ducts be constructed in a conductor-guiding part in such a way that deflection of the electrical conductors takes place at different levels or sequentially, as a result of which the insulation-displacement contacts make contact with the electrical conductors one after another so that a distinct reduction in the expenditure of force is achieved. An insulation-displacement contact formed to receive electrical conductors with different diameters may be used.

2 Claims, 3 Drawing Sheets

CONDUCTOR-CONNECTING ELEMENT FOR CONNECTING ELECTRICAL CONDUCTORS TO INSULATION-DISPLACEMENT CONTACTS

FIELD OF THE INVENTION

The invention relates to a conductor-connecting element for connecting electrical conductors to insulation-displacement contacts, wherein the insulation-displacement contacts are held in a contact-carrier and the electrical conductors are inserted in conductor-guiding ducts in a conductor-guiding part, wherein the conductors are deflected in the conductor-guiding ducts, and wherein the conductor-guiding part is moved in the direction of the contact-carrier when a cap nut is screwed on, and the conductors are pressed, in the region of the deflecting portions, into slits in the insulation-displacement contacts.

BACKGROUND OF THE INVENTION

Conductor-connecting elements of this kind are necessary in order to make contact with electrical conductors in cables, without removing the conductor insulation beforehand in a separate working operation.

A conductor-connecting end element with insulation-displacement contacts for the connection of electrical conductors is known from DE 295 12 585 U1, in which all the electrical conductors introduced into a conductor-guiding part are connected simultaneously to the insulation-displacement contacts in a contact-carrier by screwing a cap nut onto the contact-carrier.

In this known embodiment of a conductor-connecting element, relatively high forces occur, which are caused by simultaneous contact-making with the electrical conductors. This, in turn, gives rise to a high expenditure of force for screwing-on the cap nut, so that tightening the latter up by hand is often difficult. Under these circumstances, the cap nut has to be of bulky design in order to pass on the forces that occur.

SUMMARY OF THE INVENTION

The underlying object of the invention is therefore to so construct a conductor-connecting element of the type initially mentioned that a lower expenditure of energy is needed for screwing on a cap nut - and thereby for pressing electrical conductors into the insulation-displacement contacts of a contact-carrier.

This object is achieved through the fact that the conductor-guiding ducts in the conductor-guiding part are constructed in such a way that deflection of the electrical conductors takes place at different levels, the insulation-displacement contacts making contact with the electrical conductors one after another.

An advantageous refinement of the invention is indicated in claim 2.

The advantages obtained with the aid of the invention consist, in particular, in the fact that the forces and torques involved in the screwing-on of the cap nut are reduced, so that reliable contact is made with even a fairly large number of electrical conductors, in a conductor-connecting element of this kind, even without the use of a tool.

A further advantage of insulation-displacement contacts which make contact one after another lies in the fact that, when there are a number of electrical conductors, it is possible to choose which conductor is to be made contact with first. This is advantageous, for example in the case of an electrical connection which has safety implications, if a protective conductor is always to be made contact with first in the course of assembly, or is the last to lose electrical contact at the insulation-displacement contact in the course of a dismantling operation.

BRIEF DESCRIPTION OF THE DRAWINGS

An exemplified embodiment is represented in the drawings and will be explained in greater detail below. In the drawings.

DETAILED DESCRIPTION OF THE INVENTION

Figure 1:
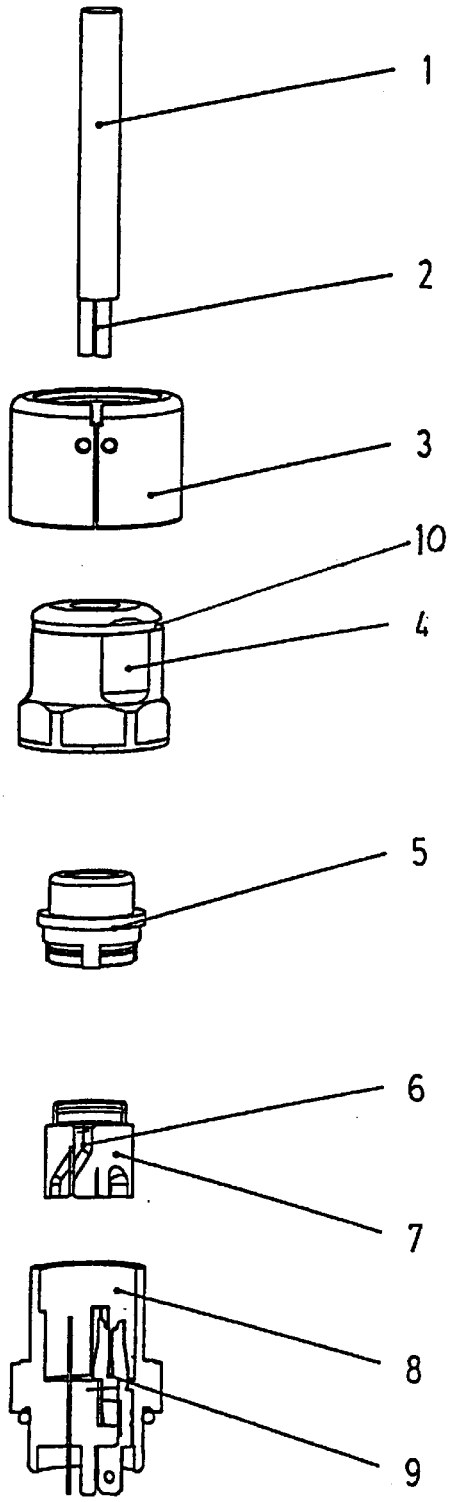
FIG. 1 shows an exploded drawing of a conductor-connecting element.

The individual parts of a conductor-connecting element are represented in FIG. 1, in an order in which they are ready for assembly.

In the course of assembly, the protective cap 3, the cap nut 4 and the tension-relieving arrangement 5 are first of all pushed over the cable 1 having the electrical conductors 2. The individual electrical conductors are then threaded into the conductor-guiding ducts 6 in the conductor-guiding part 7, and the tension-relieving arrangement 5 is brought together with the conductor-guiding part 7. The two parts are then inserted, as a unit, in the contact-carrier 8 having the insulation-displacement contacts 9 located in it, whereupon the cap nut 4 is screwed on. During the screwing of the cap nut 4 onto the contact-carrier 8, the conductor-guiding part 7 is pushed into the contact-carrier 8 and, in the process, the electrical conductors 2 in the conductor-guiding ducts 6 are pressed into the slits in the insulation-displacement contacts 9, in the course of which operation the sheathing of the conductors is split and electrical contact is produced. Finally, the protective cap 3 is placed over the cap nut 4, the said protective cap snapping, in a freely rotatable manner, into a groove 31 in the cap nut, so that unintentional demounting of the cap nut is prevented.

Figure 2:
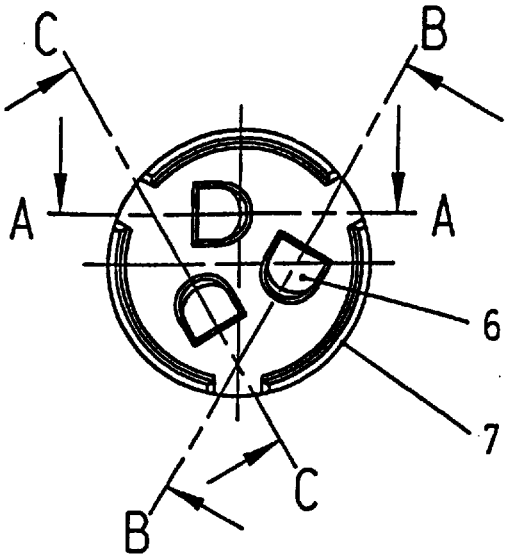
FIG. 2 shows a plan view of a conductor-guiding part.
Figure 2A:
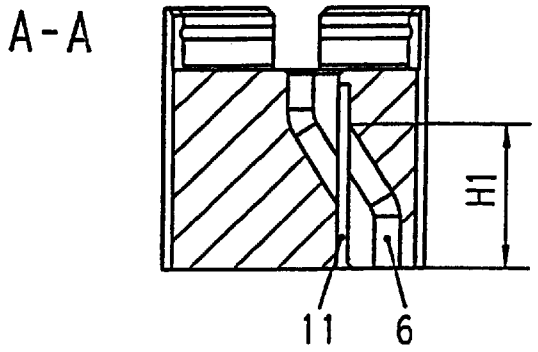
FIG. 2A shows a section along line A—A of FIG. 2.
Figure 2B:
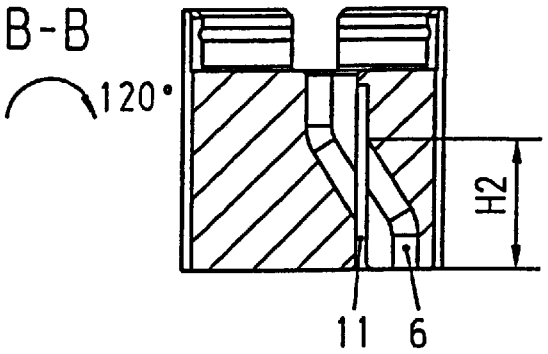
FIG. 2B shows a section along line B—B of FIG. 2.
Figure 2C:
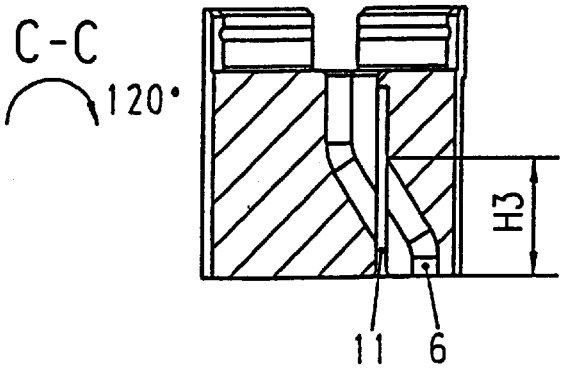
FIG. 2C shows a section along line C—C of FIG. 2.

FIG. 2 represents, in a plan view, the disposition of the conductor-guiding ducts 6 in the conductor-guiding part 7, which ducts are offset by 120° in each case. Also shownin FIGS. 2A, 2B and 2C, in a manner corresponding to the indications of the sectional lines of extension, are the appertaining sectional representations of the individual conductor-guiding ducts.

As the sectional representations A—A, B—B and C—C show, the S-shaped conductor-guiding ducts 6 extend from the upper region near the centre, to the lower region of the conductor-guiding part 7. Under these circumstances, the guide grooves 11, in which the insulation-displacement contacts 9 are guided, intersect the conductor-guiding ducts 6 at the turning points of the S-shaped conductor-guiding duct in each case. As a result of a different vertical location of the upper turning point in the individual conductor-guiding ducts 6, different bearing points H1, H2 and H3 are produced inside the conductor-guiding part. The electrical conductors 2 individually threaded-in are pressed against the said bearing points when the conductor-connecting element is screwed together, and are pressed into the slits in the insulation-displacement contacts 9.

During this operation, the cable sheathings of the individual electrical conductors are cut into in succession, starting at H3, then H2 and finally H1, by the insulation-displacement contacts 9 which are being inserted upwards into the guide grooves 11.

As a result of the successive contact-making, in which the cable sheathings of the electrical conductors are divided, one after another, by the insulation-displacement contacts in order to bring about an electrical connection with the said conductors, the forces to be applied are distributed more evenly over the rotational movement of the cap nut and are thereby ultimately reduced, referred to the force to be applied on a momentary basis.

Figure 3:
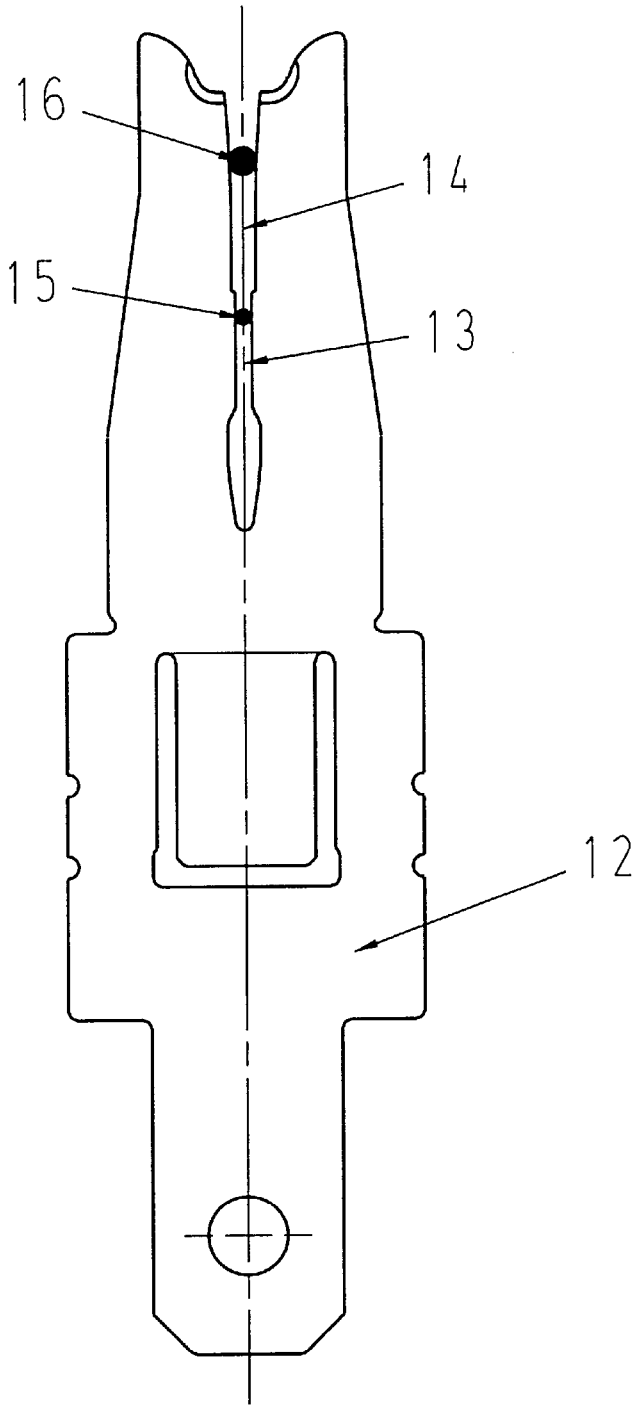
FIG. 3 shows a view of a insulation-displacement terminal for different conductor diameters.

Represented in FIG. 3 is a modified insulation-displacement terminal 12 which is constructed to receive electrical conductors with different diameters. In this instance, the conductor-receiving slit in the insulation-displacement terminal 12 is provided with two different, successive slit widths 13, 14 so that reliable contact can be made with different conductor diameters. Under these circumstances, the upper, wider slit 14 is provided for a larger conductor diameter 16, whereas the adjoining, narrower slit 13 is intended for a smaller conductor diameter 15. For the purpose of using the modified insulation-displacement terminal, provision is made for adapting the geometry of the conductor-guiding ducts 6 in the conductor-guiding part 7. This means that the conductor-guiding ducts 6 are either constructed for the larger conductor diameter 16—this corresponds to the example already described in FIGS. 2, 2A, 2B, and 2C or else the said conductor-guiding ducts 6 are constructed for the smaller conductor diameter 14. Under these circumstances, the bearing points H1, H2 and H3 (see FIGS. 2A, 2B, and 2C) are adapted according to the location of the slit region 13 of the modified insulation-displacement terminal 12, so that the same effect involving successive contact-making is ensured as is described in the case of FIGS. 2, 2A, 2B, and 2C. Thus, for the two different diameters of electrical conductors represented here by way of examples, differently designed conductor-guiding parts 7 are also required, but only one kind of modified insulation-displacement terminal 12, which terminals are locked in the contact-carrier 8.

What is claimed is:

1. A conductor-connection element for connecting electrical conductors (2), comprising a contact-carrier (8), with insulation-displacement contacts (9), a conductor-guiding part (7) with S-shaped conductor-guiding ducts (6), a tension-relieving arrangement (5) and a cap nut (4), wherein the insulation-displacement contacts are held in the contact-carrier and the electrical conductors are inserted in the S-shaped conductor-guiding ducts (6) in the conductor-guiding part (7), said S-shaped conductor-guiding ducts having a plurality of bearing points (H1, H2, H3) corresponding to the turnings points of the ducts, wherein the conductor-guiding part (7) is moved toward the contact-carrier (8) when a cap nut (4) is screwed on the contact-carrier (8), and within the S-shaped conductor-guiding ducts (6) the electrical conductors (2) are pressed into slits in the insulation-displacement contacts (9) as the contact-carrier (8) and cap nut (4) are screwed together, characterized in that the electrical conductors (2) within the S-shaped conductor-guiding ducts (6) are guided into the slits of the insulation-displacement contacts (9) as the insulation-displacements contacts are guided within grooves (11) of the conductor-guiding part (7), said slits of the insulation-displacement contacts (9) performing successive sheathing of the electrical conductors (2) at bearing points (H1, H2, H3) within the conductor-guiding part (7) to bring about an electrical connection with a minimum of rotational movement applied to the cap nut (4).

2. The conductor-connecting element according to claim 1, characterized in that the insulation-displacement contacts (12) have a plurality of slit-widths (13, 14), it being possible to make contact with different conductor cross-sections (15, 16).

* * * * *